US010690023B1

(12) United States Patent
Claywell et al.

(10) Patent No.: US 10,690,023 B1
(45) Date of Patent: Jun. 23, 2020

(54) CAM SLIDE MEMBER ACTUATOR FOR A VALVETRAIN ASSEMBLY

(71) Applicant: GM Global Technology Operations LLC, Detroit, MI (US)

(72) Inventors: Mark Claywell, Birmingham, MI (US); Maqsood Rizwan Ali Khan, Troy, MI (US); Kevin Eckerle, Northville, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/412,997

(22) Filed: May 15, 2019

(51) Int. Cl.
*F01L 13/00* (2006.01)
*F01L 1/053* (2006.01)

(52) U.S. Cl.
CPC ..... *F01L 13/0036* (2013.01); *F01L 1/053* (2013.01); *F01L 2001/0537* (2013.01)

(58) Field of Classification Search
CPC ..... F01L 2001/0473; F01L 1/053; F01L 1/46; F01L 2013/0052; F01L 2013/101; F01L 2820/031
USPC ..... 123/90.18, 90.27
See application file for complete search history.

(56) References Cited

U.S. PATENT DOCUMENTS

| | | | | |
|---|---|---|---|---|
| 9,845,712 | B2 | 12/2017 | Hayden | |
| 10,006,323 | B2 | 6/2018 | Gallon | |
| 2018/0340484 | A1 | 11/2018 | Stewart et al. | |
| 2020/0003090 | A1* | 1/2020 | Takada | F01L 1/053 |

* cited by examiner

*Primary Examiner* — Jorge L Leon, Jr.

(57) ABSTRACT

A valvetrain assembly for an internal combustion engine includes a first camshaft, a first intake cam, a second intake cam, a first cam slide member, and a first actuator. The first camshaft rotatably is supported by a cylinder head. The first intake cam and a second intake cam are disposed on and engaged with the first camshaft for common rotation. The first cam slide member is fixed for common rotation with the first and second intake cams. The first cam slide member has a pin groove disposed on the outer periphery of the first cam slide member. The pin groove includes a first side wall and a second side wall opposite the first side wall. The first actuator has a first and a second pins. The first and second pins are individually extendable into the pin groove of the first cam slide member.

11 Claims, 3 Drawing Sheets

CAM SLIDE MEMBER ACTUATOR FOR A VALVETRAIN ASSEMBLY

INTRODUCTION

The present disclosure relates generally to a camshaft assembly for an internal combustion engine and more specifically to a camshaft assembly capable of employing multiple cam profiles for any particular valve.

Recent improvements in the overall performance of internal combustion engines are attributed to the capability of engine calibrators to vary parameters associated with the valvetrain assembly. Varying parameters such as valve lift, duration, and timing will result in a change in torque output, fuel economy, and emissions performance among other engine performance characteristics. In the past, however, changing the lift height of an intake valve would require a partial engine teardown and replacement of the camshaft.

Current engine design provides calibrators the capability to change these parameters to fit needs of the operator in any particular moment. New engine hardware is required to provide this capability. Along with new and additional engine hardware comes new ways for engine hardware to fail. Thus, it is extremely important to provide engines with more performance capability while maintaining or improving quality and keeping costs as low as possible.

Accordingly, there is a need in the art for a valvetrain assembly providing improved engine capability while maintaining quality and durability while improving cost to manufacture.

SUMMARY

A valvetrain assembly for an internal combustion engine is provided. The valvetrain assembly includes a first camshaft, a first intake cam, a second intake cam, a first cam slide member, and a first actuator. The first camshaft rotatably is supported by a cylinder head. The first intake cam and a second intake cam are disposed on and engaged with the first camshaft for common rotation. The first cam slide member is fixed for common rotation with the first and second intake cams. The first cam slide member has a pin groove disposed on the outer periphery of the first cam slide member. The pin groove includes a first side wall and a second side wall opposite the first side wall. The first actuator is supported by the cylinder head. The first actuator has a first and a second pins. The first and second pins are individually extendable into the pin groove of the first cam slide member.

In one example of the present disclosure, the first and second pins of the first actuator have an elliptical axial profile.

In another example of the present disclosure, the elliptical axial profile of the first and second pins have a major axis and a minor axis.

In yet another example of the present disclosure, the major axis of the elliptical axial profile has a first length and the minor axis of the elliptical axial profile has a second length.

In yet another example of the present disclosure, the first length of the major axis is about 40% longer than the second length of the minor axis.

In yet another example of the present disclosure, the pin groove of the first cam slide member further includes a first surface and a shift portion. The first surface faces radially outward and is disposed between the first and second side walls.

In yet another example of the present disclosure, the first surface of the pin groove includes a first ramp and a second ramp.

In yet another example of the present disclosure, the major axis of the elliptical axial profile of the first and second pins is aligned with a direction of rotation of the first cam slide member.

Another example of a valvetrain assembly for an internal combustion engine is provided. The valvetrain assembly includes a first camshaft, a first intake cam, a second intake cam, a first cam slide member, and a first actuator. The first camshaft rotatably supported by a cylinder head. The first intake cam and a second intake cam are disposed on and engaged with the first camshaft for common rotation. The first cam slide member is fixed for common rotation with the first and second intake cams. The first cam slide member has a pin groove disposed on the outer periphery of the first cam slide member. The pin groove includes a first side wall, a second side wall opposite the first side wall, a first surface, and a shift portion. The first surface faces radially outward and is disposed between the first and second side walls. The first actuator is supported by the cylinder head. The first actuator has a first pin and a second pin. The first and second pins are individually extendable into the pin groove of the first cam slide member and have an elliptical axial profile.

In one example of the present disclosure, the elliptical axial profile of the first and second pins have a major axis and a minor axis.

In another example of the present disclosure, the major axis of the elliptical axial profile has a first length and the minor axis of the elliptical axial profile has a second length.

In yet another example of the present disclosure, the first length of the major axis is about 40% longer than the second length of the minor axis.

In yet another example of the present disclosure, the first surface of the pin groove includes a first ramp and a second ramp.

In yet another example of the present disclosure, the major axis of the elliptical axial profile of the first and second pins is aligned with a direction of rotation of the first cam slide member.

Another example of a valvetrain assembly for an internal combustion engine is provided. The valvetrain assembly includes a first camshaft, a first intake cam, a second intake cam, a first cam slide member, and a first actuator. The first camshaft rotatably supported by a cylinder head. The first intake cam and a second intake cam are disposed on and engaged with the first camshaft for common rotation. The first cam slide member fixed for common rotation with the first and second intake cams. The first cam slide member has a pin groove disposed on the outer periphery of the first cam slide member. The pin groove includes a first side wall, a second side wall opposite the first side wall, a first surface, and a shift portion. The first surface faces radially outward and is disposed between the first and second side walls. The first actuator is supported by the cylinder head. The first actuator having a first pin and a second pin. The first and second pins are individually extendable into the pin groove of the first cam slide member and have an elliptical axial profile including a major axis and a minor axis.

In one example of the present disclosure, the major axis of the elliptical axial profile has a first length and the minor axis of the elliptical axial profile has a second length.

In another example of the present disclosure, the first length of the major axis is about 40% longer than the second length of the minor axis.

In yet another example of the present disclosure, the first surface of the pin groove includes a first ramp and a second ramp.

In yet another example of the present disclosure, the major axis of the elliptical axial profile of the first and second pins is aligned with a direction of rotation of the first cam slide member.

In yet another example of the present disclosure, the major axis of the elliptical axial profile is about 7 mm and the minor axis of the elliptical axial profile is about 5 mm.

The above features and advantages and other features and advantages of the present disclosure are readily apparent from the following detailed description when taken in connection with the accompanying drawings.

BRIEF DESCRIPTION OF THE DRAWING

The drawings described herein are for illustration purposes only and are not intended to limit the scope of the present disclosure in any way.

DESCRIPTION

The following description is merely exemplary in nature and is not intended to limit the present disclosure, application, or uses.

Figure 1:
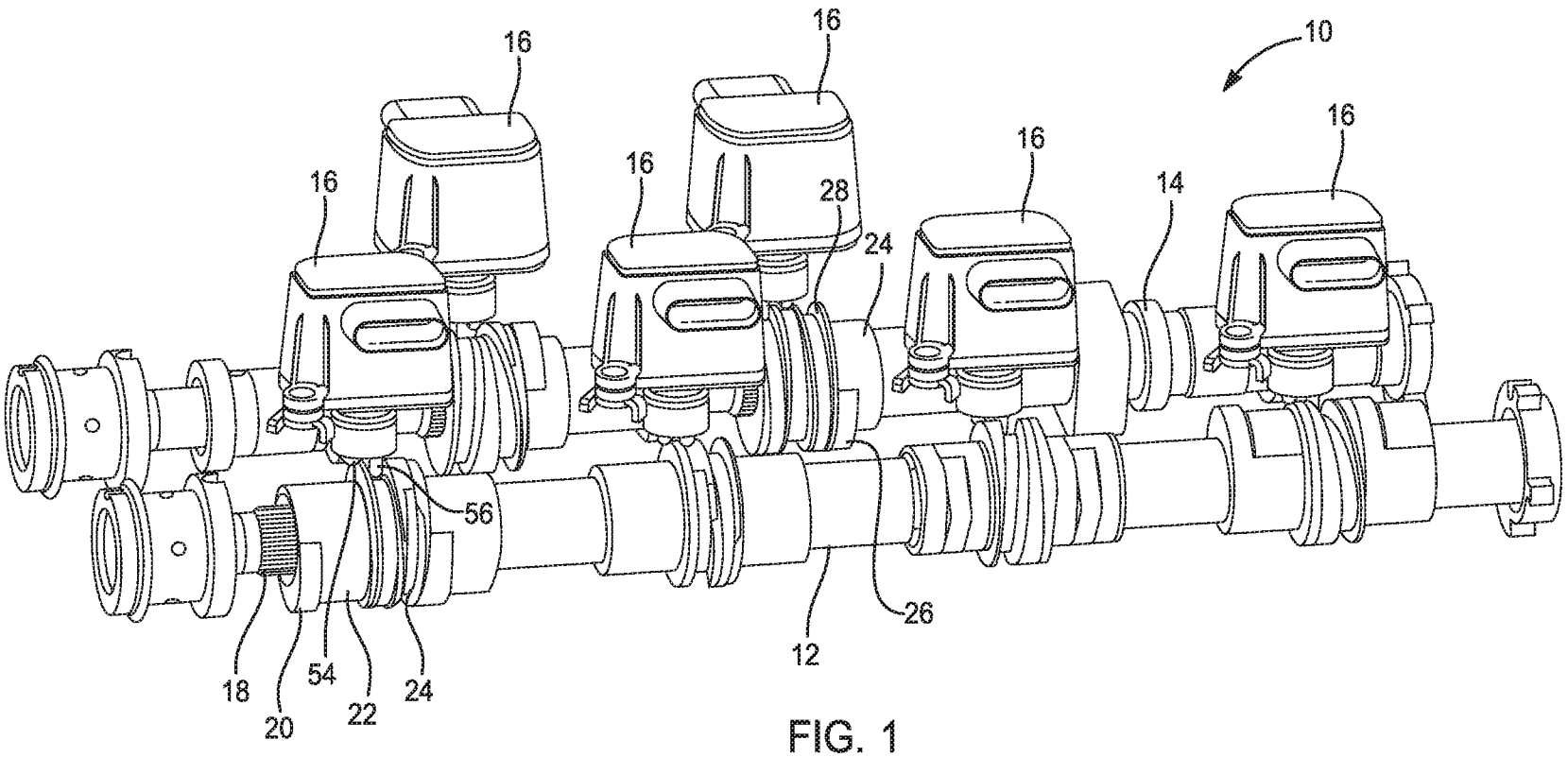
FIG. 1 is a perspective view of a portion of a camshaft assembly for an internal combustion engine according to the principles of the present disclosure.

Examples of the present disclosure advantageously provide a valvetrain assembly for an internal combustion engine. The valvetrain assembly, illustrated in general in FIG. 1, is labeled as reference number 10 and will now be described. The valvetrain assembly 10 includes a first cam shaft assembly 12, a second cam shaft assembly 14 and a plurality of actuators 16. In the present example, the cam shaft assemblies 12, 14 are rotatably supported by a cylinder head (not shown) and are thus considered an overhead cam assembly. However, a cam shaft assembly may also be supported by a cylinder block of an engine having a "V" configuration in which the actuation of the cylinder head valves is accomplished through pushrods. Additionally, other engine configurations may also be considered without departing from the scope of the present disclosure.

The first cam assembly 12 receives a rotational driving force from a crankshaft (not shown) through a belt, chain, or gear that is engaged with a cam sprocket or a cam phaser. In this regard, the first cam assembly 12 is engaged with the crankshaft to spin in common. The first cam assembly 12 includes a first intake cam shaft 18, a first intake valve cam 20, a second intake valve cam 22, and a first intake cam slide member 24. While there is one first intake cam shaft 18 for each bank of cylinders, there may be more than one set of first intake valve cams 20 and second intake valve cams 22 dedicated to each cylinder. This design depends upon the number of intake valves (not shown) servicing each cylinder. The first intake valve cam 20 provides a different valve lift profile than the second intake valve cam 22. For example, the first intake valve cam 20 may provide more lift, a longer lift duration, and advance or retard lift timing or any combination of valve dynamic characteristics. Likewise, the second cam assembly 14 actuates the exhaust valves of the cylinders. In this regard, the second cam assembly 14 similarly includes a first exhaust valve cam 24, a second exhaust valve cam 26, and a first exhaust cam slide member 28 for each cylinder. In the current disclosure the first and second cam assemblies 12, 14 actuate the intake and exhaust valves in a similar manner. Thus, the description of the valvetrain assembly 10 focuses on the first or intake cam assembly 12.

The first intake cam 20, second intake cam 22, and first intake cam slide member 24 are splined to the first intake cam shaft 18 to allow for common rotation with the first intake cam shaft 18 while remaining relatively free to move axially along the first intake cam shaft 18. Furthermore, the first intake cam 20, second intake cam 22, and first intake cam slide member 24 are fixed to each other such that the first intake cam 20, second intake cam 22, and first intake cam slide member 24 move axially and rotatively in common. Thus, the first intake cam 20, second intake cam 22, and first intake cam slide member 24 may even be fashioned as a common part without departing from the scope of the invention.

Figure 2:
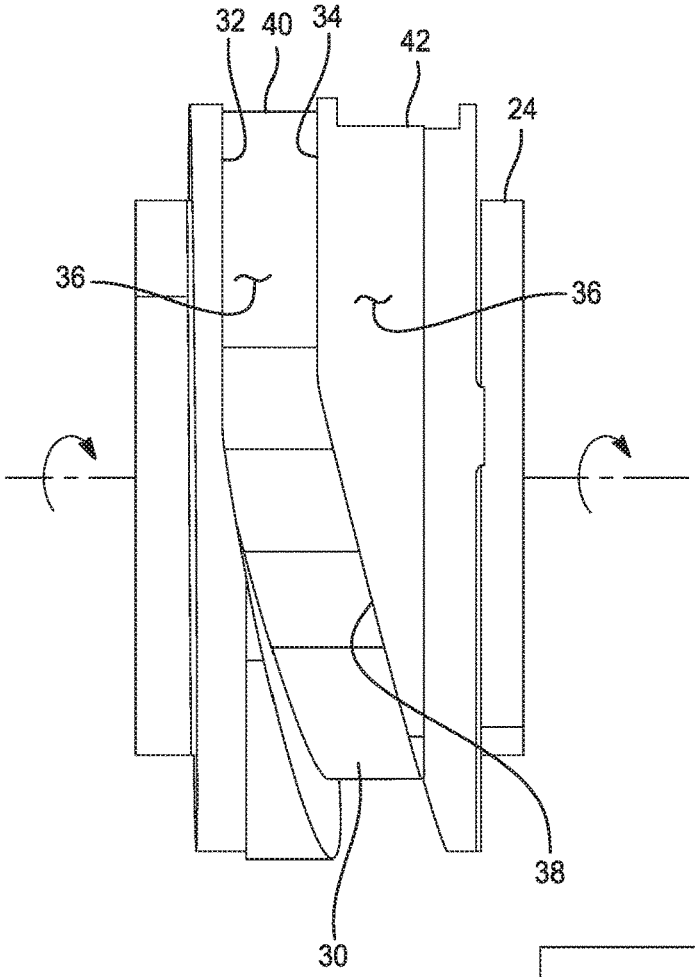
FIG. 2 is a side view of a cam slide member according to the principles of the present disclosure.
Figure 3:
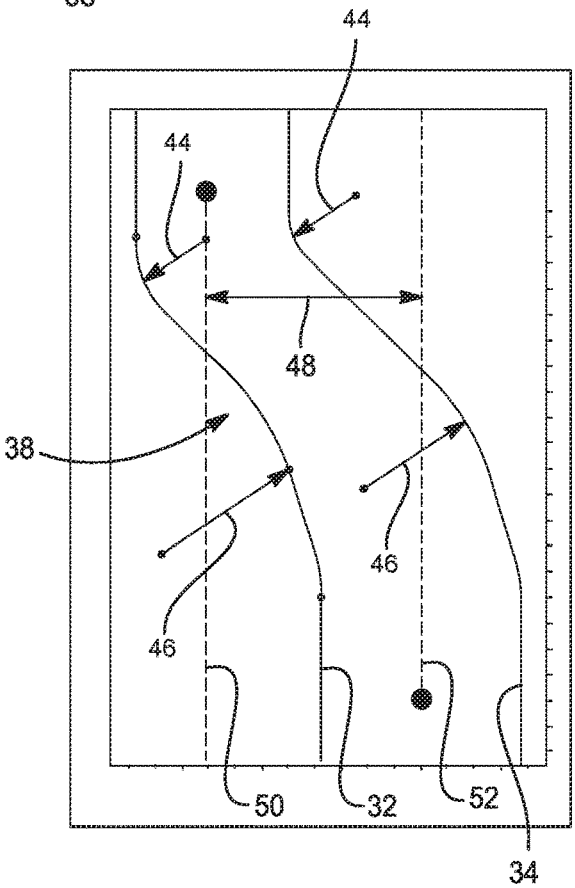
FIG. 3 is a chart depicting the geometry of a cam slide member according to the principles of the present disclosure.

Referring now to FIG. 2, the first intake cam slide member 24 includes a pin groove 30 disposed on the outer periphery of the first cam slide member 24. The pin groove 30 is defined by a first or catch side wall 32, a second or push side wall 34, a first or bottom surface 36, and a slide portion 38. More particularly, the second side wall 34 is disposed opposite and predominately mirrors the first side wall 32. The first surface 36 includes a first or entrance ramp portion 40 and a second or exit ramp portion 42. The slide portion 38 is a jog or bend in the pin groove 30 and is formed by a first radius 44, and a second radius 46 in each of the first and second side walls 32, 34. The second radius 46 is larger than the first radius 44 and the pitch 48 between a first and second centerlines 50, 52 formed by the slide portion 38 is approximately the distance between the centerlines of each of the first and second cams 20, 22.

Figure 4:
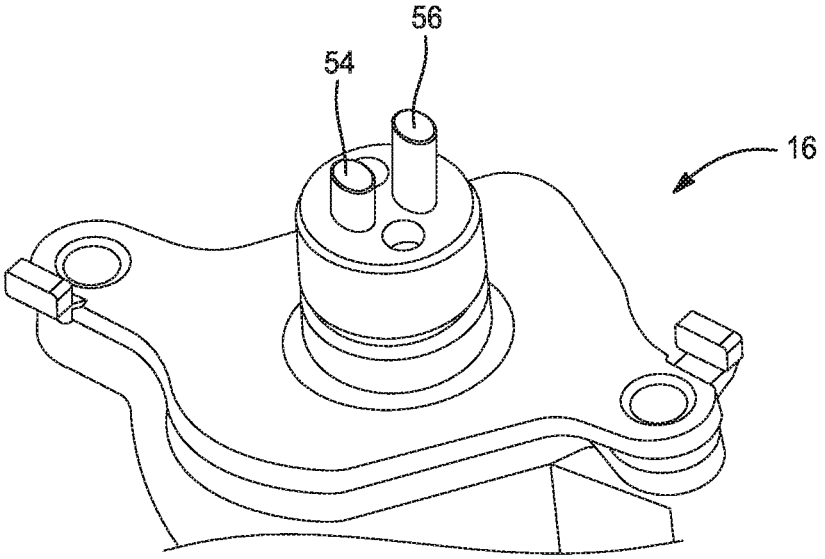
FIG. 4 is a perspective view of an actuator for a cam slide member according to the principles of the present disclosure.
Figure 5:
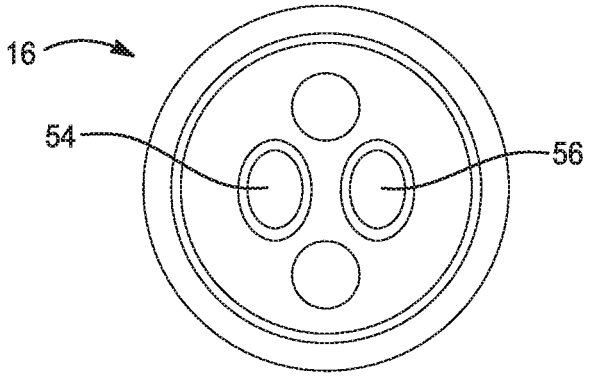
FIG. 5 is an end view of an actuator for a cam slide member according to the principles of the present disclosure.
Figure 6:
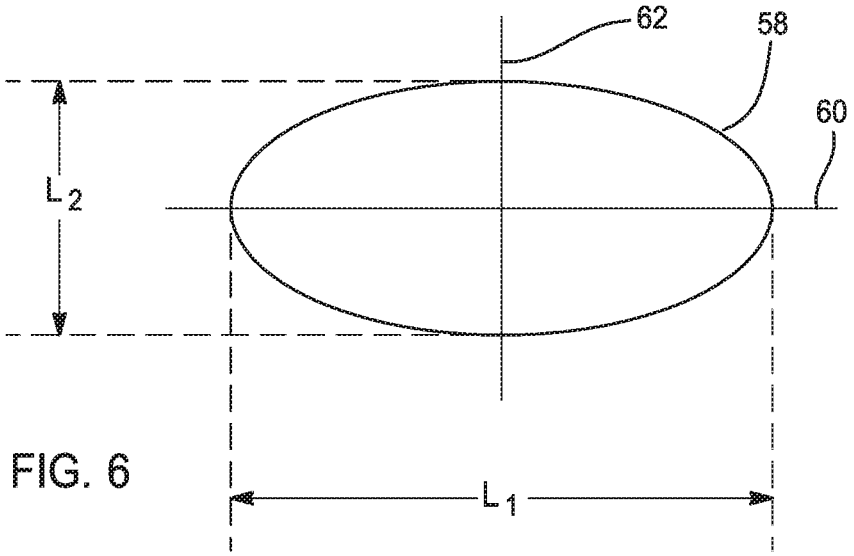
FIG. 6 is a schematic cross section of a pin of an actuator according to the principles of the present disclosure.

Turning now to FIGS. 4-6, the first actuator 16 is illustrated including a first and a second actuator pin 54, 56. The first and second pins 54, 56 are individually extendable into the pin groove 30 of the first cam slide member 24. The first and second pins 54, 56 have an elliptical profile or cross section 58 defined more clearly in FIG. 6. The elliptical cross section 58 has a major axis 60 and a minor axis 62 perpendicular to the major axis 60. The major axis 60 has a first length $L_1$ that is approximately 40% longer than the second length $L_2$ of the minor axis 62, however, other ratios of the first length $L_1$ and the second length $L_2$ may be considered without departing from the scope of the disclosure. For example, the disclosure dictates that the minor axis 62 of the first and second pins 54, 56 is short enough to engage the pin groove 30 between the first and second walls 32, 34. The disclosure considers a major axis 60 of about 7 mm and a minor axis 62 of about 5 mm in length. The major axis 60 is aligned with the centerlines 50, 52 of the pin groove 30 and must be short enough to pass through the slide portion 38 of the pin groove 30.

As the present disclosure predominantly considers a symmetrical elliptical cross section of the first and second pins 54, 56, an asymmetrical cross section is also contemplated. While the elliptical cross section provides a larger contact area between the first and second pins 54, 56 and the first and second walls 32, 34 of the pin groove 30, other cross sections having an oval shape maintain the larger contact area while minimizing the risk of the first and second pins 54, 56 locking in the slide portion 38 of the pin groove 30. The increase in contact area while maintaining the same force results in lower contact stress on the first and second pins 54, 56. Therefore, other cross sectional shapes may be considered for the first and second pins 54, 56 without departing from the scope of the disclosure.

While examples have been described in detail, those familiar with the art to which this disclosure relates will recognize various alternative designs and examples for practicing the disclosed structure within the scope of the appended claims.

The following is claimed:

1. A valvetrain assembly for an internal combustion engine, the valvetrain assembly comprising:

a first camshaft rotatably supported by a cylinder head;

a first intake cam and a second intake cam fixed to a first cam slide member disposed on and engaged with the first camshaft so as to co-rotate with the first camshaft, wherein the first cam slide member has a pin groove disposed on an outer periphery of the first cam slide member, the pin groove including a first side wall and a second side wall opposite the first side wall; and a first actuator supported by the cylinder head, the first actuator having a first pin and a second pin each configured to extend into the pin groove and each having an elliptical axial profile.

2. The valvetrain assembly of claim 1 wherein the elliptical axial profile includes a major axis and a minor axis.

3. The valvetrain assembly of claim 2 wherein the major axis has a first length and the minor axis has a second length.

4. The valvetrain assembly of claim 3 wherein the first length is 40% longer than the second length.

5. The valvetrain assembly of claim 2 wherein the major axis is aligned with a direction of rotation of the first cam slide member.

6. A valvetrain assembly for an internal combustion engine, the valvetrain assembly comprising:

a first camshaft rotatably supported by a cylinder head;

a first intake cam and a second intake cam fixed to a first cam slide member disposed on and engaged with the first camshaft so as to co-rotate with the first camshaft, wherein the first cam slide member has a pin groove disposed on an outer periphery of the first cam slide member, the pin groove including a first side wall, a second side wall opposite the first side wall, a first surface, and a shift portion, and the first surface faces radially outward and is disposed between the first and second side walls; and a first actuator supported by the cylinder head, and wherein the first actuator has a first pin and a second pin each configured to extend into the pin groove and each having an elliptical axial profile.

7. The valvetrain assembly of claim 6 wherein the elliptical axial profile includes a major axis and a minor axis.

8. The valvetrain assembly of claim 7 wherein the major axis has a first length and the minor axis has a second length.

9. The valvetrain assembly of claim 8 wherein the first length is 40% longer than the second length.

10. The valvetrain assembly of claim 9 wherein the first surface includes a first ramp and a second ramp.

11. The valvetrain assembly of claim 10 wherein the major axis is aligned with a direction of rotation of the first cam slide member.

* * * * *